United States Patent [19]

Rozzelle

[11] 4,253,657

[45] Mar. 3, 1981

[54] SOUNDING DEVICE

[76] Inventor: Rodney R. Rozzelle, 12707 Rubens Ave., Los Angeles, Calif. 90066

[21] Appl. No.: 21,574

[22] Filed: Mar. 19, 1979

[51] Int. Cl.[3] ..... A63J 5/04

[52] U.S. Cl. ..... 272/14; D21/65; 46/193

[58] Field of Search ..... 272/14; 46/177, 174, 46/175 175 AR, 191, 192, 193, 189, 190, 155; 84/103, 402, 403, 404, 406, 418, 421; D21/64, 65; 35/33

[56] References Cited

U.S. PATENT DOCUMENTS

| | | | |
|---|---|---|---|
| D. 130,942 | 12/1941 | Davis | D21/65 |
| D. 141,809 | 7/1945 | Delano | D21/65 |
| D. 141,812 | 7/1945 | Delano | D21/65 |
| 238,465 | 3/1881 | White | 46/191 |
| D. 247,455 | 3/1978 | Hagland-Ahrnborg | D21/65 |
| 2,228,554 | 1/1941 | Brown | 35/33 |
| 2,268,683 | 1/1942 | Zadek et al. | 46/193 |
| 2,678,517 | 5/1954 | Gibson | 46/177 |
| 2,961,796 | 11/1960 | Davis | 46/175 R X |
| 3,252,242 | 5/1966 | Zalkind | 46/155 X |

OTHER PUBLICATIONS

Creative Playthings–1971, p. 3, Stick Rattle, Princeton, N.J. 08540.

*Primary Examiner*—Richard C. Pinkham
*Assistant Examiner*—Arnold W. Kramer
*Attorney, Agent, or Firm*—Rodney R. Rozzelle

[57] ABSTRACT

A sounding device with a shaft upon which is loosely attached and randomly spaced a plurality of discs. Located opposite the discs and securely attached to the shaft is a sphere shaped member which is used for gripping the shaft and limiting movement of the discs. Securely attached to the other end of the shaft is a stop. Located between the stop and the discs a plunger is slidably mounted to the shaft so that the discs may be struck together for producing a hand clapping sound.

1 Claim, 8 Drawing Figures

SOUNDING DEVICE

BACKGROUND OF THE INVENTION

Field of the Invention

This invention pertains to sounding devices, more particularly to sounding devices of a mechanical nature.

SUMMARY OF THE INVENTION

A sounding device which comprises a shaft upon which is mounted a plurality of randomly spaced discs and a plunger for striking the discs together. When the discs are struck together by the plunger a sound of multiple hand claps is produced.

An important object of this invention is to enable one person to produce the sound of several people clapping hands simultaneously. With the foregoing in mind it is obvious that my novel invention is economical and practical in that it may be used in the recording industry, film dubbing, live bands and cheerleaders.

DESCRIPTION OF THE PREFERRED EMBODIMENTS

Figure 1:
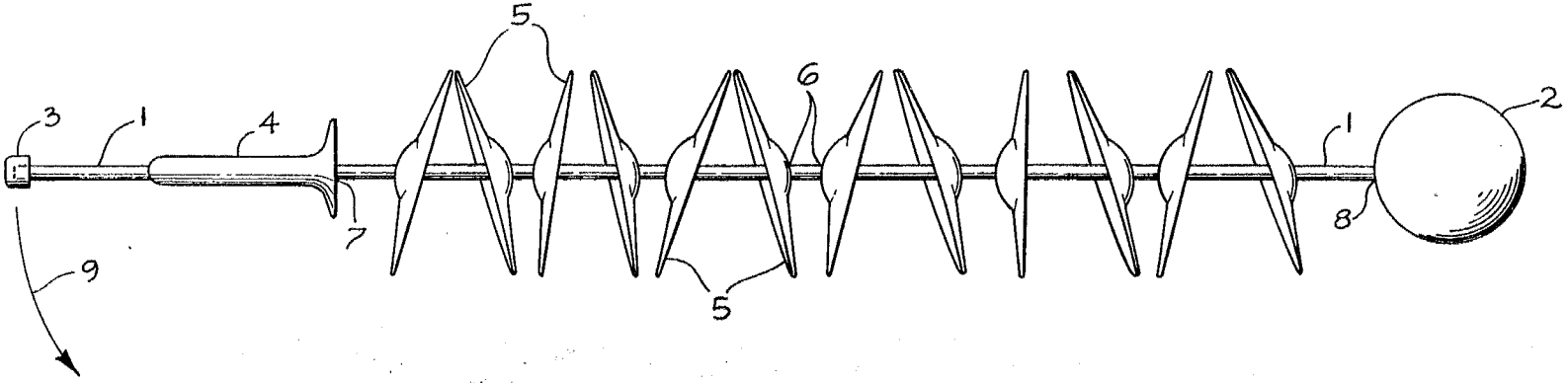
FIG. 1 is a view of sounding device in accordance with this invention.
Figure 3:
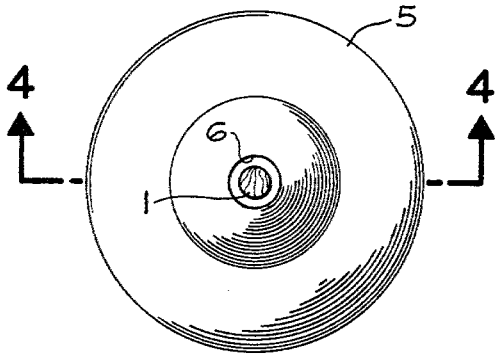
FIG. 3 is a top view of disc.

Referring to the drawings there is shown in FIG. 1 a shaft 1 to which a plurality of discs 5 are loosely attached and randomly spaced. Each disc 5 as shown in FIG. 3 has a hole 6 in its center slightly larger than the diameter the shaft 1 for allowing the discs 5 to be mounted and dangle on the shaft 1. This random spacing and dangling of discs 5 on shaft 1 as shown in FIG. 1 causes discs 5 when struck together to produce a slightly uneven clapping sound like a group of people clapping hands.

Figure 4:
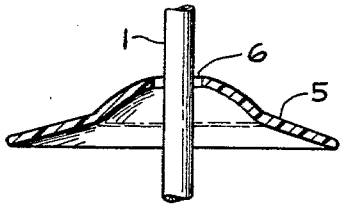
FIG. 4 is a cross section view of disc taken at line 4—4 of FIG. 3.

The shape of discs 5 exemplified in FIG. 3 and 4 and there alternate combination on shaft 1 as illustrated in FIG. 1 further contribute to the simulated sound of hands clapping when the discs 5 are struck together.

Figure 5:
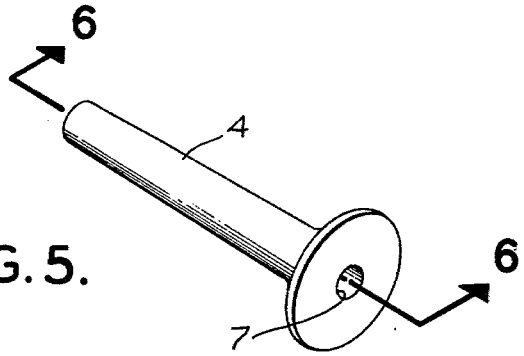
FIG. 5 is a prespective view of plunger.
Figure 6:
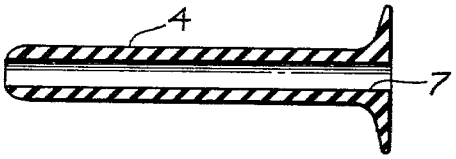
FIG. 6 is a cross section view of plunger taken at line 6—6 of FIG. 5.
Figure 7:
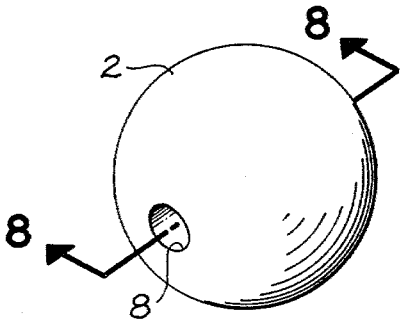
FIG. 7 is a prespective view of spherical member.
Figure 8:
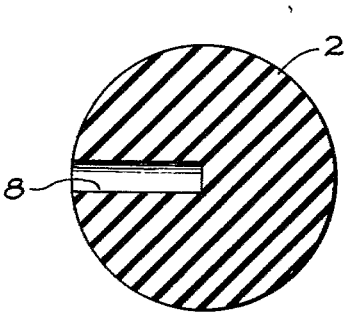
FIG. 8 is a cross section of sphere taken at line 8—8 of FIG. 7.

The means for striking the discs 5 is a plunger 4 that has a hole 7 through its center as shown in FIGS. 5 and 6, thereby allowing it to be slidably mounted to the shaft 1. The plunger is positioned on the shaft 1 opposite the discs 5 therefore when the plunger 4 is moved in the direction of the discs 5 as shown by line 3, illustrated in FIG. 2 the discs 5 will strike each other.

Figure 2:
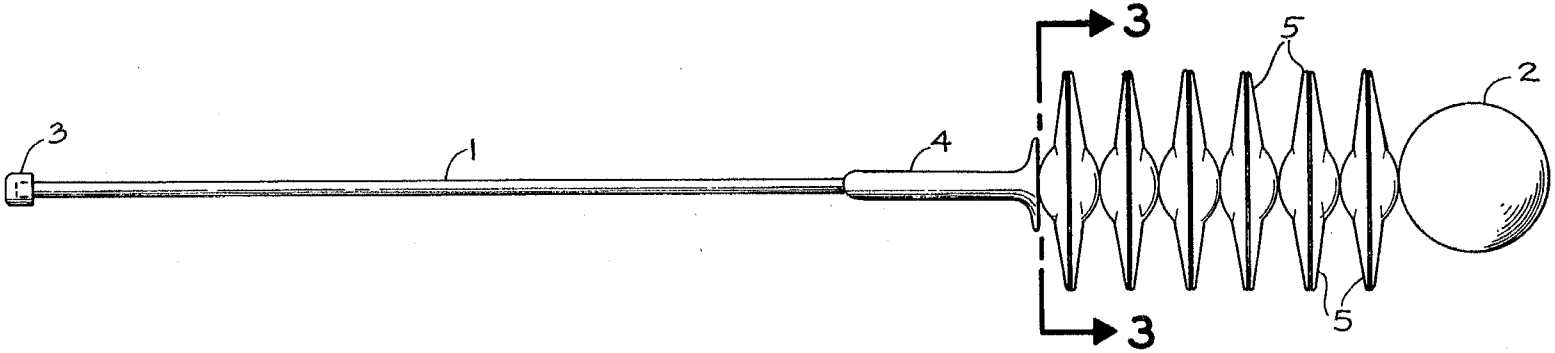
FIG. 2 is a view of the same sounding device in operation.

At one end of the shaft 1 and opposite the plunger 4 as shown in FIGS. 1 and 2 a stop 3 is firmly attached for limiting the movement of the plunger 4. At the other end of the shaft 1 and opposite the discs 5 a sphere shaped member 2 having a hole 8 in its center Whereby it is securely attached to the shaft 1 provides a means for limiting the movement of the discs 5 and gripping the shaft 1.

I claim:

1. A sounding device comprising:

a shaft having enlarged hand grip means adjacent one end and enlarged stop means adjacent the other end;

a plunger having a hole therthrough slidably mounted on said shaft;

and a plurality of several pairs of clapper discs, each clapper disc being configured the same as the others and consisting of a continuous stepped double concave inner face and a double convex outer face with a hole through the center thereof and with the pairs of discs loosely and slidably mounted on the shaft between the hand grip means and plunger with the concave faces of each pair facing each other whereby on movement of the plunger away from the enlarged stop means and forcing the loosely mounted pairs of discs towards the hand grip means causes the pairs of discs when struck together to produce a slightly uneven clapping sound like a group of people clapping hands.

* * * * *